US006094935A

United States Patent [19]

Stein

[11] Patent Number: 6,094,935

[45] Date of Patent: Aug. 1, 2000

[54] DRINKING RECEPTACLE WITH REMOVABLE CHILLING LINER

[76] Inventor: Hal Stein, 1402 2nd St., West Babylon, N.Y. 11704

[21] Appl. No.: 09/231,638

[22] Filed: Jan. 15, 1999

[51] Int. Cl.[7] ..... F25D 3/08

[52] U.S. Cl. ..... 62/457.3; 62/457.4; 62/530

[58] Field of Search ..... 62/457.3, 530, 62/457.4

[56] References Cited

U.S. PATENT DOCUMENTS

| | | | |
|---|---|---|---|
| 3,766,975 | 10/1973 | Todd . | |
| 4,163,374 | 8/1979 | Moore et al. . | |
| 4,183,226 | 1/1980 | Moore . | |
| 4,681,239 | 7/1987 | Manns et al. . | |
| 4,705,085 | 11/1987 | Brown . | |
| 4,720,023 | 1/1988 | Jeff . | |
| 5,005,374 | 4/1991 | Spitler | 62/259.3 |
| 5,875,646 | 3/1999 | Rich | 62/457.3 |

*Primary Examiner*—Henry Bennett
*Assistant Examiner*—Mark Shulman
*Attorney, Agent, or Firm*—Terrance L. Siemens

[57] ABSTRACT

A drinking container having a removable, freezable member. The drinking container has a cylindrical inner receptacle and a surrounding cylindrical outer receptacle. An annular chamber is formed between the inner and outer receptacles. A refrigerant member comprising a plastic envelope containing a freezable gel is dimensioned to fit into the annular chamber, and is readily removable therefrom. A cap engages the drinking container to retain the refrigerant member once placed in the annular chamber. The refrigerant member is preferably an annular sleeve which slips between the inner and outer receptacles, and folds flat for storage and freezing. The inner receptacle projects above the outer receptacle so that the user is obliged to engage only one wall with the mouth and lips, thereby enjoying comfortable drinking, rather than being obliged to span the combined thickness of the inner and outer receptacle walls together with the refrigerant member when drinking. Optionally, the drinking container has an external handle for grasping.

10 Claims, 2 Drawing Sheets

DRINKING RECEPTACLE WITH REMOVABLE CHILLING LINER

BACKGROUND OF THE INVENTION

1. Field of the Invention

The present invention relates to beverage drinking receptacles, and more particularly to cups, steins, mugs, and other hand held drinking containers. The novel receptacle has a removable liner installed to chill the receptacle, and which liner is removed for freezing after it has warmed to the point that it will no longer maintain a beverage at a low temperature. The invention finds utility in commercial and institutional eating and drinking establishments, but also by individual consumers. The novel drinking receptacle is, for example, particularly suitable for fishing trips, hiking, picnics, seashore trips, and other outdoors activities. This can be used as a general purpose container. However, for purposes of exposition of the details of the invention, the invention is described as a drinking cup.

2. Description of the Prior Art

Insulated drinking receptacles have become quite popular in recent years. Suitable materials have been developed which enable such receptacles to be inexpensively manufactured and put into widespread use. Such receptacles typically comprise an insulated circumferential wall and floor. In an improvement to insulated drinking receptacles, a thermal storage feature has been added. A freezable gel is disposed within the walls of the drinking receptacle so that the gel serves as a refrigerant.

Examples are seen in U.S. Pat. No. 4,163,374, issued to Stanley R. Moore et al. on Aug. 7, 1979, and U.S. Pat. No. 4,183,226, issued to Stanley R. Moore on Jan. 15, 1980. By contrast with these devices, the novel drinking receptacle has an inner cylindrical wall surrounded by an outer cylindrical wall, both walls forming part of one solid member. The inner cylindrical wall extends well above the outer wall, so that the user has oral access to a thin walled drinking receptacle. In the aforementioned prior art devices, inner and outer walls are separate parts. Also, the prior art devices have inner and outer walls of equal height, so that the combined thickness of the walls together with entrapped refrigerant is considerably greater than in the present invention. In the present invention, difference in wall height reduces the thickness of the wall engaged by the mouth of the user for greater comfort while drinking.

A drinking receptacle shown in U.S. Pat. No. 3,766,975, issued to Gary P. Todd on Oct. 23, 1973, features entrapped refrigerant liquid. However, it is not contained within a flexible enclosure, as occurs in the present invention. Also, the inner receptacle, which in Todd's device is that holding the beverage, is a separate member entrapped in interfering fit by a cap which threads to the body. By contrast, in the present invention, the inner receptacle is integral with the outer receptacle. Also, in the present invention, a threaded cap is configured to allow the inner receptacle to project above the cap.

U.S. Pat. No. 4,681,239, issued to Michael C. Manns et al. on Jul. 21, 1987, and U.S. Pat. No. 4,720,023, issued to Michael J. Jeff on Jan. 19, 1988, both illustrate holders which cooperate with separate containers such as metallic cans. These prior art devices lack an inner receptacle which is integral with the outer receptacle, a freezable gel refrigerant, and a cap entrapping and containing the gel refrigerant, all of which are characteristics of the present invention.

U.S. Pat. No. 4,705,085, issued to Dwight C. Brown on Nov. 10, 1987, illustrates an inflatable jacket which is intended to encircle a can or the like. This device lacks a rigid inner receptacle and a rigid outer receptacle, a removable enclosed gel refrigerant, and a cap which closes the refrigerant within a generally annular space between the inner and outer receptacles, as does the present invention.

None of the above inventions and patents, taken either singly or in combination, is seen to describe the instant invention as claimed.

SUMMARY OF THE INVENTION

The present invention provides a drinking receptacle having a removable, freezable refrigerant member. The receptacle has two concentric cylindrical walls, one being an inner wall and one being an outer wall. The inner wall encircles the drinking receptacle. A generally annular space existing between the inner and outer walls receives the removable refrigerant member.

The refrigerant member is a flexible envelope containing a freezable substance, such as a gel. Water containing methylcellulose is a well known example of a suitable freezable gelling material. The gel is contained in a synthetic resin envelope which can be removed from the drinking receptacle, and placed in a freezer. It is not necessary to freeze the entire drinking receptacle to chill the refrigerant. This reduces freezing time, since the receptacle itself would otherwise act as an insulator delaying satisfactory freezing of the refrigerant.

The drinking receptacle includes a removable cap which closes only the open chamber which receives the refrigerant member. The cap both retains the refrigerant member, assists in insulating the same, and excludes condensate from the refrigerant chamber. The inner wall of the drinking receptacle extends upwardly past the cap, which has a central opening to accommodate the relatively high inner wall. Extension of the inner wall obliges the user to engage only one thin wall by the mouth when drinking. Total thickness of the refrigerant chamber and its outer wall are thus prevented from interfering with comfortable drinking.

It should be emphasized that the two walled receptacle is formed in a single, unitary member. By contrast, the refrigerant member and the cap are both readily separable from the receptacle. For its part, the refrigerant member is formed either in annular form or as a flexible planar member dimensioned and configured to cooperate closely with the inner wall and to fit readily into the annular chamber separating the inner and outer walls. In either form, the refrigerant member can fold relatively flat for compact storage. This is particularly advantageous since it occupies limited space in a freezer. It is therefore easy to insert the refrigerant member in a crowded freezer without removing any of the contents of the freezer.

Accordingly, it is one object of the invention to provide a drinking receptacle having a removable chilling or refrigerant member.

It is another object of the invention to avoid exposing the mouth of the user to a thick wall when drinking.

It is a further object of the invention that the refrigerant member be easy to maneuver into a freezer and insert into the novel drinking receptacle.

Still another object of the invention is to insulate the refrigerant member when it is installed in the drinking receptacle, to retain the refrigerant member securely within the receptacle, and to exclude condensate from the refrigerant member.

An additional object of the invention is to minimize freezing time of the refrigerant.

Yet another object of the invention is to employ a known refrigerant in flexible form that cooperates with the drinking receptacle.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
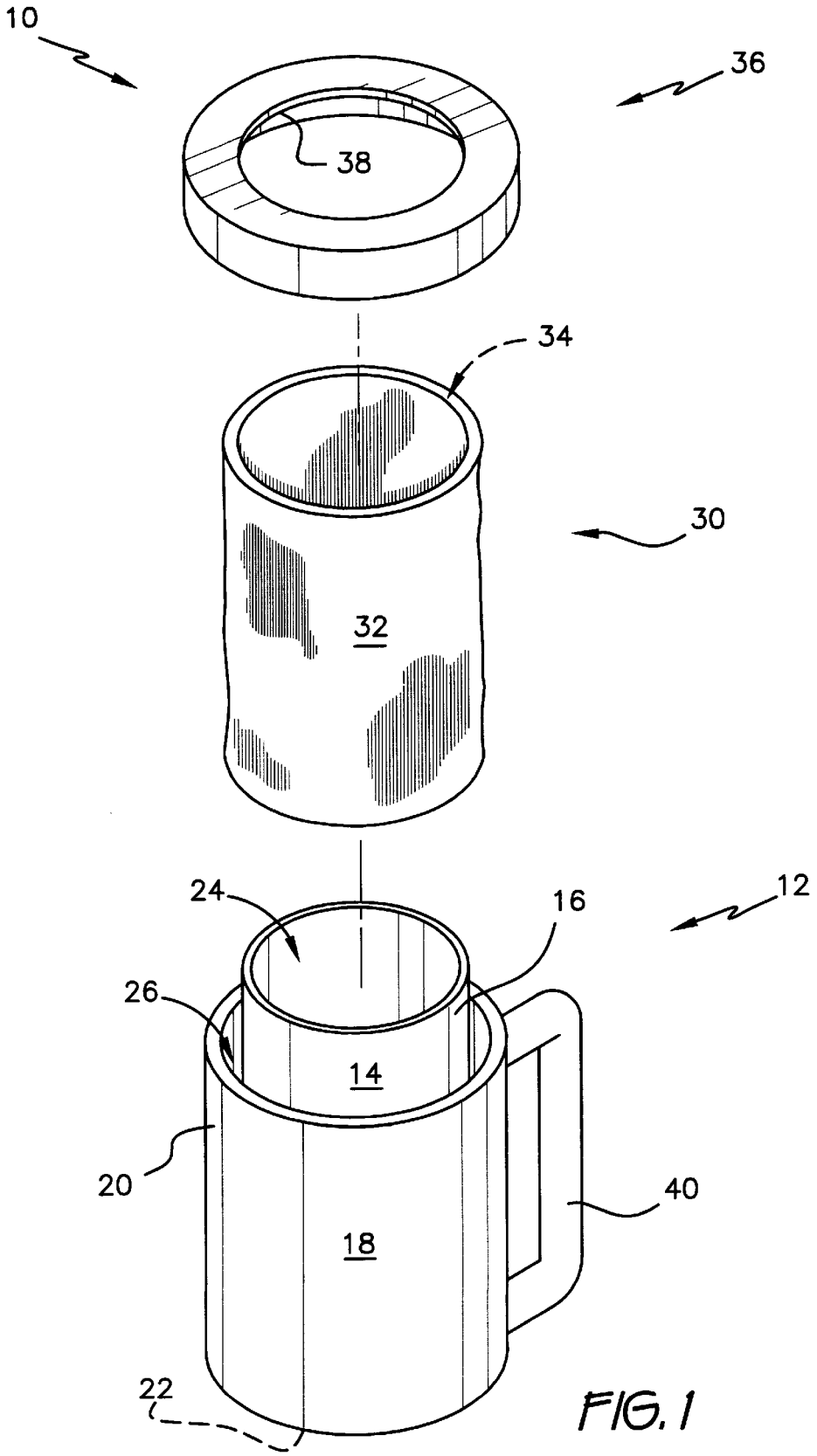
FIG. 1 is an exploded, perspective view of the invention.

Turning now to FIG. 1 of the drawings, novel drinking container 10 is seen to comprise a unitary body 12 formed as a single part. Body 12 includes a first wall 14 forming an upwardly open inner receptacle 16 and a second wall 18 forming an upwardly open outer receptacle 20. Both receptacles 16, 20 are closed at their respective lower ends, as depicted in FIG. 1, by a common floor 22 incorporating walls 14, 18 into body 12. A chamber 24 for containing beverages (not shown) is provided within receptacle 16. A generally annular chamber 26 is formed between inner receptacle 16 and outer receptacle 20.

A refrigerant member 30 is provided for chilling beverages placed within receptacle 24. Refrigerant member 30 comprises a flexible and heat absorbing envelope 32 enclosing a freezable gelling material 34. Preferably, member 30 is a flexible, annular sleeve dimensioned and configured to fit into and be received within chamber 26. Envelope 32 is constituted from a material selected to be flexible at room temperature, and thus is can be folded flat when gelling material 34 is not frozen. Member 30 can be manually removed from chamber 26 when gelling material 34 is not frozen. Refrigerant member 30 is thus removable from body 12, so that it can be placed into a freezer (not shown) without requiring that the entire drinking container 10 be placed into the freezer.

A cap 36 dimensioned and configured to engage body 12 closes chamber 26. Cap 36 is separate from body 12 and manually removable therefrom. Cap 36 may engage wall 18 by resilient friction fit, by threads (not shown), by tongue and groove structure (not shown), or in any other suitable way. Cap 36 has a central opening 38 enabling wall 14 to pass therethrough.

Figure 2:
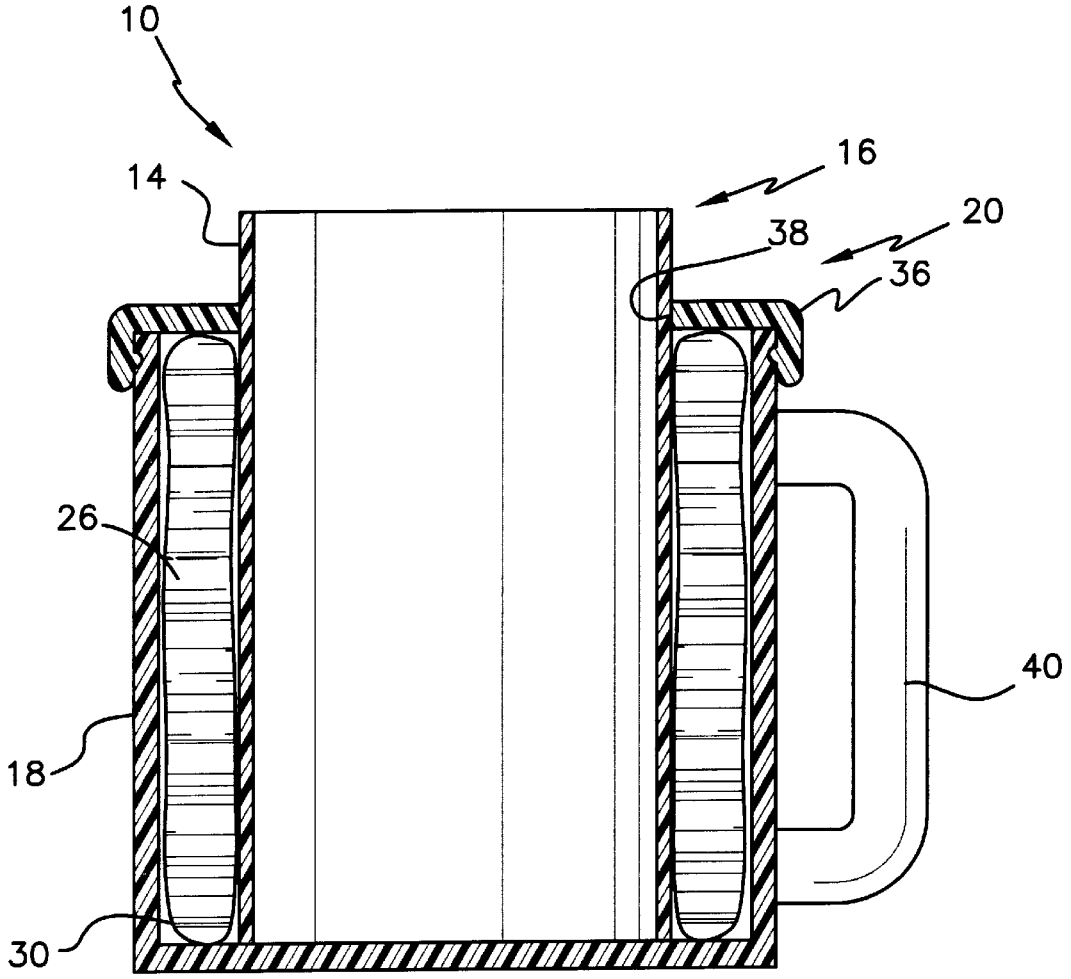
FIG. 2 is a side elevational, cross sectional view of the invention with all components assembled for use.

Referring now to FIG. 2, it will be seen that wall 14 extends above second wall 18, and protrudes through opening 38 above cap 36 when cap 36 is installed on and engaged with body 12. This feature affords access to the lips and mouth (not shown) of a user who wishes to drink from container 10, without obliging the user to engage the combined thicknesses of receptacle 16, receptacle 20, and chamber 26. Drinking is thereby made considerably more comfortable and convenient than would otherwise be the case. Simultaneously, removable refrigerant member 30 is protected from dirt, spills, condensate, and other influences which could contaminate and hasten warming of member 30.

In a preferred embodiment, body 12 includes an external handle 40 fixed to wall 18.

The novel drinking container may be readily fabricated by molding from well known materials, novelty residing in the dimensions and configurations of the container. Likewise, well known materials may be employed to fill envelope 32 of member 30. There is no requirement that the material change from fluid to solid state, but merely that it be flexible when warm and be capable of absorbing sufficient heat when chilled to maintain a beverage at or near ordinary freezing temperatures for a period typical of that which may pass when a person consumes a beverage. Also, the artisan will recognize that the working fluid, having a high heat capacity, could be preheated for the purpose of warming a beverage.

It is to be understood that the present invention is not limited to the embodiments described above, but encompasses any and all embodiments within the scope of the following claims.

I claim:

1. A container having a removable heat transfer member, comprising:

a body having a first inner wall forming an upwardly open inner receptacle closed at its lower end and a second outer wall of a height different from that of said inner wall forming an upwardly open outer receptacle which surrounds said inner receptacle, wherein said body is formed in a single, unitary part incorporating both said first inner wall and said second outer wall, wherein a generally annular chamber having an open top and a closed bottom is formed between said inner receptacle and said outer receptacle, and said first inner wall extends in height above said second outer wall, thereby obliging the user to engage only the thickness of a single wall when drinking; and a separate heat transfer member dimensioned and configured to be received in said generally annular chamber and to be manually removable therefrom.

2. The container according to claim 1, further comprising a separate cap dimensioned and configured to engage said body and thereby close said open top of said generally annular chamber, wherein said cap has a central opening enabling said first wall to pass through said opening and to extend above said cap when said cap is installed on and engaged with said body.

3. The container according to claim 1, wherein said heat transfer member comprises a flexible envelope enclosing a freezable gelling material.

4. The container according to claim 3, wherein said heat transfer member is constituted, dimensioned, and configured to be able to be folded flat when said gelling material is not frozen.

5. The container according to claim 1, wherein said heat transfer member is a flexible, annular sleeve.

6. The container according to claim 1, wherein said second wall has an external handle.

7. A container having a removable heat transfer member, comprising:

a body having a first inner wall forming an upwardly open inner receptacle and a second outer wall of height different from that of said first inner wall forming an upwardly open outer receptacle closed at its lower end which surrounds said inner receptacle, wherein said body is formed in a single, unitary part incorporating both said first inner wall and said second outer wall, a generally annular chamber having an open top and a closed bottom is formed between said inner receptacle and said outer receptacle, said first inner wall extends above said second outer wall, thereby obliging the user to engage only the thickness of a single wall when drinking, and said second outer wall has an external handle;

a separate heat transfer member comprising a flexible envelope enclosing a freezable gelling material, wherein said heat transfer member is dimensioned and configured as an annular sleeve to be received in said generally annular chamber and to be manually removable therefrom, and to be folded flat when said gelling material is not frozen; and a separate cap dimensioned and configured to engage said body and thereby close said generally annular chamber, wherein said cap has a central opening enabling said first wall to pass through said opening and to extend above said cap when said cap is installed on and engaged with said body.

8. A container having a removable heat transfer member, comprising:

a body having a first inner wall forming an upwardly open inner receptacle closed at its lower end and a second outer wall of a height different from that of said inner wall forming an upwardly open outer receptacle which surrounds said inner receptacle, wherein said body is formed in a single, unitary part incorporating both said first inner wall and said second outer wall, and includes a floor common to said inner receptacle and said outer receptacle, wherein a generally annular chamber having an open top and a closed bottom is formed between said inner receptacle and said outer receptacle, and one of said first inner wall and said second outer wall extends in height above the other one of said first inner wall and said second outer wall, whereby a user is obliged to engage only the thickness of a single wall when drinking; and a separate heat transfer member dimensioned and configured to be received in said generally annular chamber and to be manually removable therefrom.

9. The container according to claim 8, further comprising a separate cap dimensioned and configured to engage said body and to close at least said outer receptacle.

10. The container according to claim 8, wherein said body includes an external handle.

* * * * *